US006259351B1

(12) United States Patent
Radosavljevic et al.

(10) Patent No.: US 6,259,351 B1
(45) Date of Patent: Jul. 10, 2001

(54) TOGGLE AND SLIDE DIMMER SWITCH

(75) Inventors: Dejan Radosavljevic, Lafayette; Michael R. Bryndzia, Baldwinsville; Andrea Burke, Palmyra, all of NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 09/410,457

(22) Filed: Oct. 1, 1999

(51) Int. Cl.[7] ..... H01C 10/38

(52) U.S. Cl. ..... 338/176; 338/197; 338/199; 338/153

(58) Field of Search ..... 338/74, 153, 176, 338/184, 194, 199, 197

(56) References Cited

U.S. PATENT DOCUMENTS

| | | | | |
|---|---|---|---|---|
| 2,846,552 | * | 8/1958 | Winz | 338/108 |
| 3,746,923 | * | 7/1973 | Spira et al. | 338/184 |
| 3,972,017 | * | 7/1976 | Dohanic, Jr. et al. | 338/184 |
| 4,117,445 | * | 9/1978 | Foreman et al. | 338/198 |
| 4,131,870 | * | 12/1978 | Hilgendorf et al. | 338/183 |
| 4,559,515 | * | 12/1985 | Takezawa | 338/128 |
| 4,654,626 | * | 3/1987 | Carsello | 338/172 |
| 4,835,343 | * | 5/1989 | Graef et al. | 174/66 |
| 5,262,678 | * | 11/1993 | Flowers et al. | 307/125 |
| 5,349,323 | * | 9/1994 | Shigemoto et al. | 338/176 |
| 5,489,891 | | 2/1996 | Diong et al. . | |
| 5,519,263 | | 5/1996 | Santana, Jr. . | |
| 6,078,249 | * | 6/2000 | Slavik et al. | 338/180 |

OTHER PUBLICATIONS

Specifier Reports Abstract: Occupancy Sensors, Jan. 1993, vol. 1, No. 5, National Lighting Product Information Program.

The Stockroom: Occupancy Sensor, 1999, Leviton Manufacturing Co., Inc., Little Neck, New York.

Passive Wall Sensor Alert, 1999, The International Brotherhood of Electrical Workers.

Lutron Product and Technical Information: Beautiful Dimmers for Every Room, 1998, Lutron Electronics, Co., Inc., Coopersburg, PA.

Seri Lee, Electronics Cooling: How to Select a Heat Sink, 1999, Aavid Thermal Technologies, Lacavia, NH.

World Class Dimming, 1999, Beacon Light Products, Inc.

* cited by examiner

*Primary Examiner*—Karl D. Easthom
(74) *Attorney, Agent, or Firm*—Wall Marjama & Bilinski

(57) ABSTRACT

The present invention presents an electrical control box which provides a common platform for either a sliding switch or a toggling switch. The present invention uses the same PC board for both types of operation. A common wrap around heat sink provides a large surface area for dissipating heat. The present invention allows a triac to be mounted in close proximity on the circuit board of the electrical control box rather than toward the front surface of the electrical control box so as to simplify assembly. Screws for attaching to external wiring are mounted on the back body.

18 Claims, 7 Drawing Sheets

TOGGLE AND SLIDE DIMMER SWITCH

FIELD OF THE INVENTION

The present invention relates to an electrical control box for easy convertibility between multiple modes of operation. More specifically, it relates to a dimmer switch which uses the same back body, PC board, and strap-heat sink but allows adaptation for either toggle switch or slide switch operation.

BACKGROUND OF THE INVENTION

Although the simple binary toggle switch is still the primary lighting control device in most homes due to cost, dimmers and other new lighting controls are often preferred for handling many lighting tasks more efficiently. By controlling the intensity of the light according to needed or desired parameters, dimmers reduce wasted electricity, saving money and natural resources. A dimmer permits lowered or raised light levels so that they are appropriate to the need. For example, a bathroom dimmer can be set to a low setting for restful light when bathing or napping, then raised to a higher intensity setting to apply makeup.

Most dimmers today are solid-state devices. They actually switch off and on very rapidly—120 times per second. Because the human eye integrates, it perceives the light as a product of how long the current is in the "off" and "on" cycles.

Dimmers save money. First, they significantly cut wasted energy by using only the amount of electricity needed. When a light is dimmed 25%, a dimmer saves about 20% of the electricity required. When dimmed by 50%, it saves 40% of the electricity. Second, a dimmer greatly extends lamp life because it reduces strain on the filament. When dimmed 25%, a lamp lasts 4 times longer than it would at full power, and dimmed by 50%, it will last as much as 20 times longer.

No special wiring is needed for a dimmer—it may replace any conventional light switch, but there are specially-rated dimmers for fluorescent or low-voltage lighting and fans. Dimmers must be selected with ratings to handle the type and load of fixtures it will control.

Dimmers may be operated with a toggle, a dial, a slide, a paddle switch, a touch-pad or electronic button; some types integrate two or more of these methods to handle different tasks. Whereas in a binary toggle switch the switch simply moves between an on and an off position, in dimmer switch applications the toggle switch is movable between multiple operative positions.

Prior art dimmer switches include those which operate with the toggle switch and those which operate with a slide switch. A known prior art device incorporates a PC board. The planar extension of the PC board is perpendicular to the planar extension of the face plate.

There is a need for a dimmer electrical control box which is capable of being adapted for use with a toggle switch or a sliding switch which utilizes a common PC board in the electrical control box to promote versatility. There is also a need for a dimmer electrical control box where manufacturing costs are reduced by enabling the use of common components for two different products, one using a toggle switch and one using a sliding switch.

Also, it is desirable for an electrical control box to use screw terminals as this facilitates hook up to external wiring. Prior art devices have instead relied on leads coming out of the electrical control box.

SUMMARY OF THE INVENTION

The present invention relates to an electrical control box that is easily assembled with a toggle switch or a slide switch. The electrical control boxes of this invention employ the same back body, the same PC board and accompanying components, and the same strap-heat sink, but are adaptable to accommodate either a slide dimmer switch or a toggle dimmer switch.

An objective of the present invention is to provide a large surface heat sink which allows a triac to be mounted with the other discrete components on the circuit board of the box instead of far removed from the circuit board, thus avoiding the need for long lead lines. This permits PC board mounting which is parallel to the face plate. Additionally, this permits using screw terminals with pressure plates and does not rely upon lead wires coming out of the electrical control box as in various prior art devices.

This invention relates to an electrical control box for dimmer operation having a slide potentiometer and adapted to use either a slide switch or a toggle operatively coupled to the slide potentiometer. This invention permits a triac to be mounted with short lead lines onto the circuit board inside the electrical control box assembly. The configuration of the present invention yields a compact and versatile device.

According to various embodiments, this invention provides an electrical lighting dimmer device, comprising: a back body; a circuit board supported by the back body; a potentiometer connected to the circuit board; a link actuator operably connected to the potentiometer; and a metal strap comprising a planar surface and a ground flap that extends from the strap planar surface and is in electrical connection with a ground terminal mounted on the back body, wherein the link actuator is connectable to both a lever arm of a toggle switch and a bar of a slide switch. Manufacturing costs are reduced in that the same back body, circuit board, metal strap and link actuator may be employed to manufacture either a toggle operated dimmer switch or a slide operated dimmer switch.

According to other embodiments, this invention provides an electrical lighting dimmer device, comprising: a slide potentiometer; a link actuator operably connected to the slide potentiometer and including a pin; and a lever arm comprising a pivot point, a longitudinal aperture in a lower portion of the lever arm below the pivot point in which the link actuator pin is received, and a toggle switch connected to an upper portion of the lever arm above the pivot point; wherein arcuate movement of the toggle switch is translated to linear movement of the link actuator. Additionally, the invention relates to a lighting control device comprising: a back body including a back surface, side walls extending from the back surface, and an open front face; a circuit board supported on interior surfaces of the back body side walls, the circuit board having a major planar surface that is essentially parallel to the back body back surface and a potentiometer mounted thereon, the circuit board and potentiometer providing a signal to control intensity of light; and a link actuator connecting the potentiometer to a dimmer switch. This type of link actuator, and orientation of the circuit board, facilitates the device accommodating either a toggle or slide switch.

DETAILED DESCRIPTION OF THE PREFERRED EMBODIMENT

The present invention relates to an electrical control box with common components which accommodates either a slide switch or a toggle switch by using the same variable resistor or potentiometer. The electrical control box of the present invention also may make connections with the outside wiring by means of screw terminals rather than lead lines. In the present invention, in toggle switch mode, travel of the toggle is smooth.

The electrical control box comprises a back body, a PC board assembly, an optional barrier adjacent the PC board assembly, and a heat sink. These components may accommodate either a slide switch assembly or a toggle switch assembly. The electrical control box further comprises a slide switch arm or a toggle lever arm, and a cover specific to the slide or toggle switch. The assembly may also include a decorative face cover.

According to preferred embodiments, the electrical control box has screw terminals which connect to external electrical wiring extending through building walls. The external wiring is part of the building wiring and can be connected to lamp loads or the like which are to be controlled by a switching device. The back body encloses the switching mechanism which is employed and insulates it from accidental contact with wires or grounds within the electrical control box. Any internal lead lines are connected to the outside wiring through screw terminals. External wiring from the building connects to the electrical control box through looping around the screw or passing the external wiring through entry points in proximity to the screws on the back body.

Figure 1:
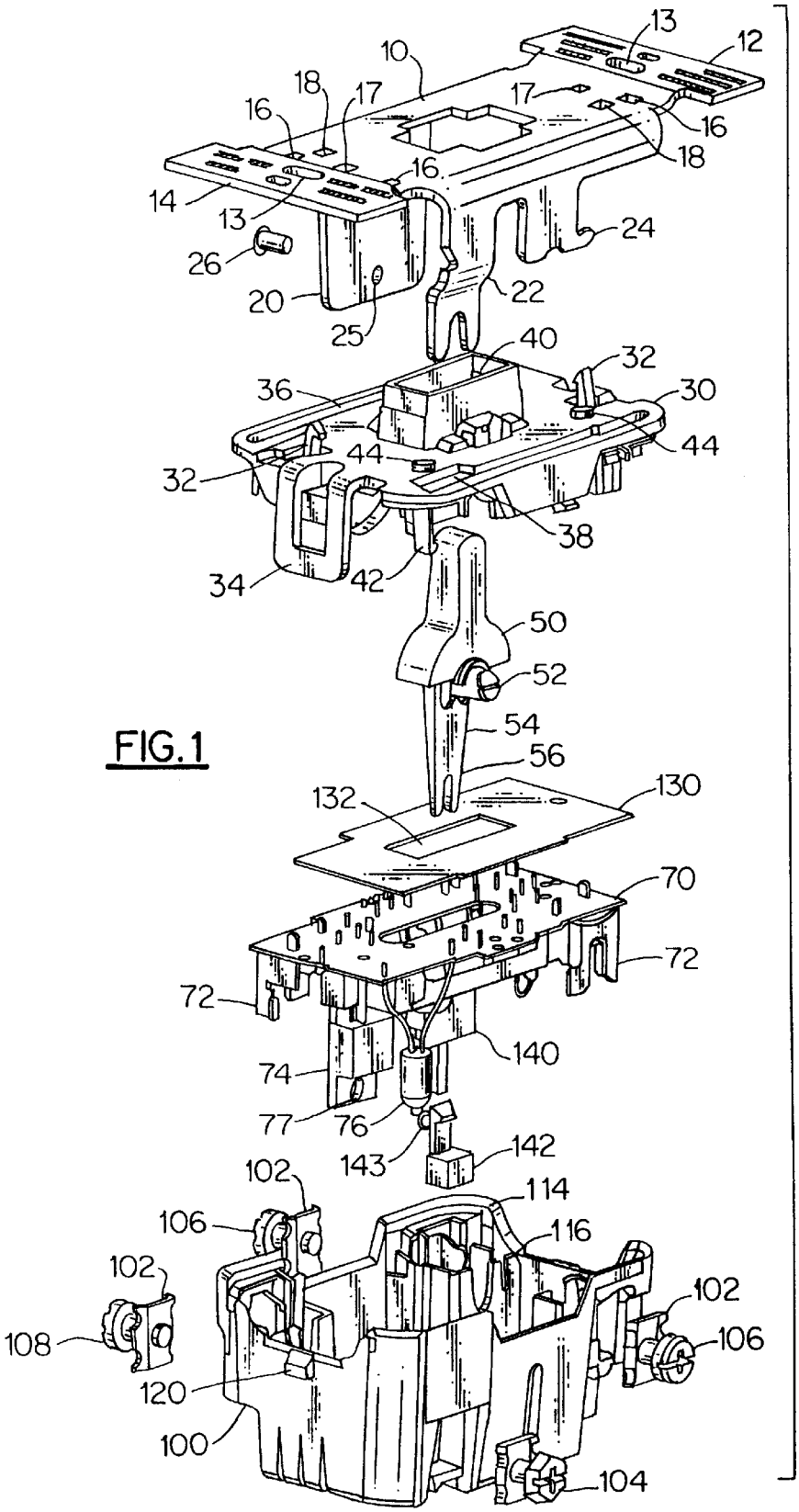
FIG. 1 shows an exploded view of an electrical control box according to an embodiment of this invention which has been adapted for toggle switching.
Figure 2:
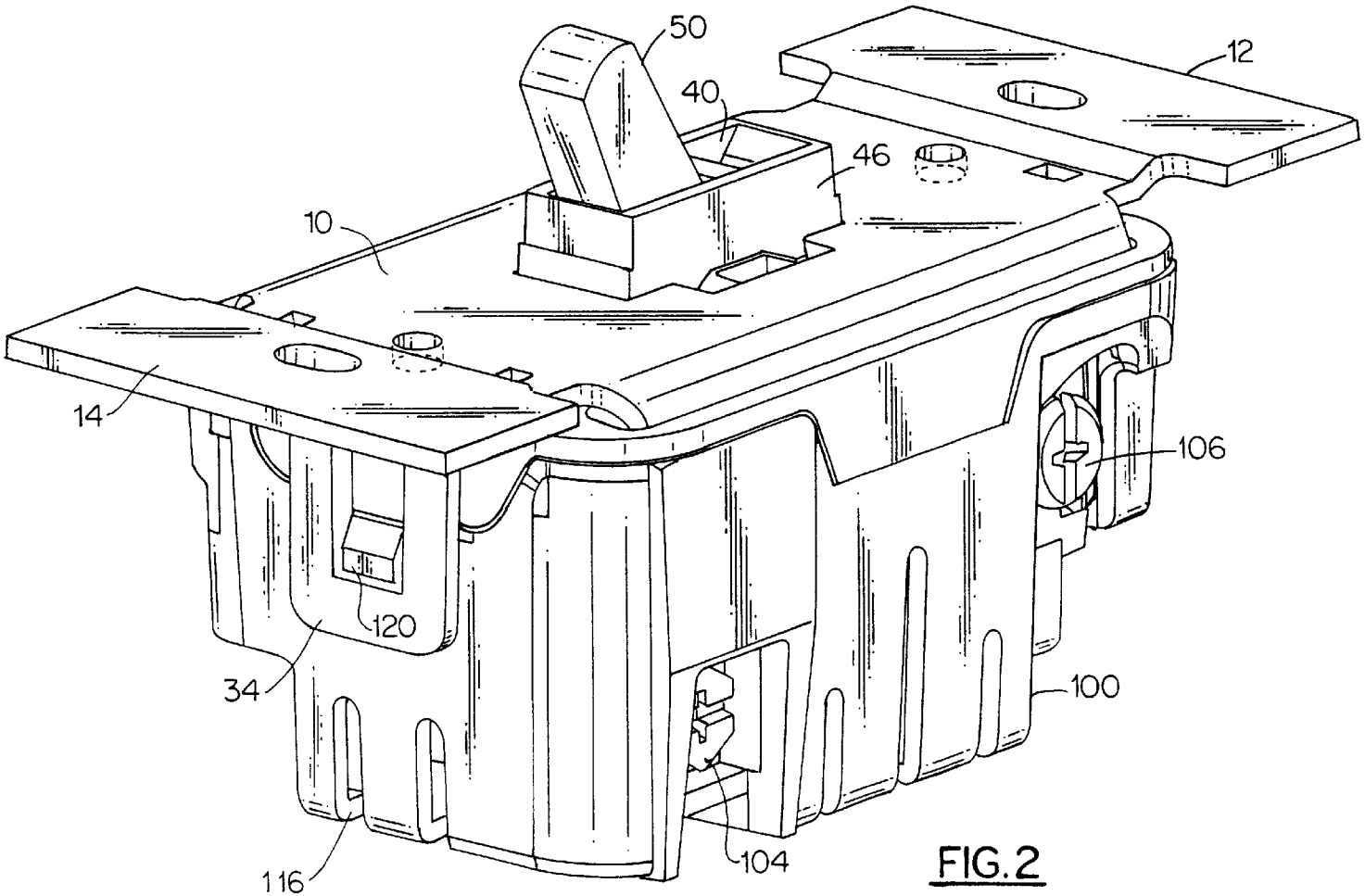
FIG. 2 shows an assembled electrical control box adapted for toggle switching according to another embodiment of this invention.
Figure 3:
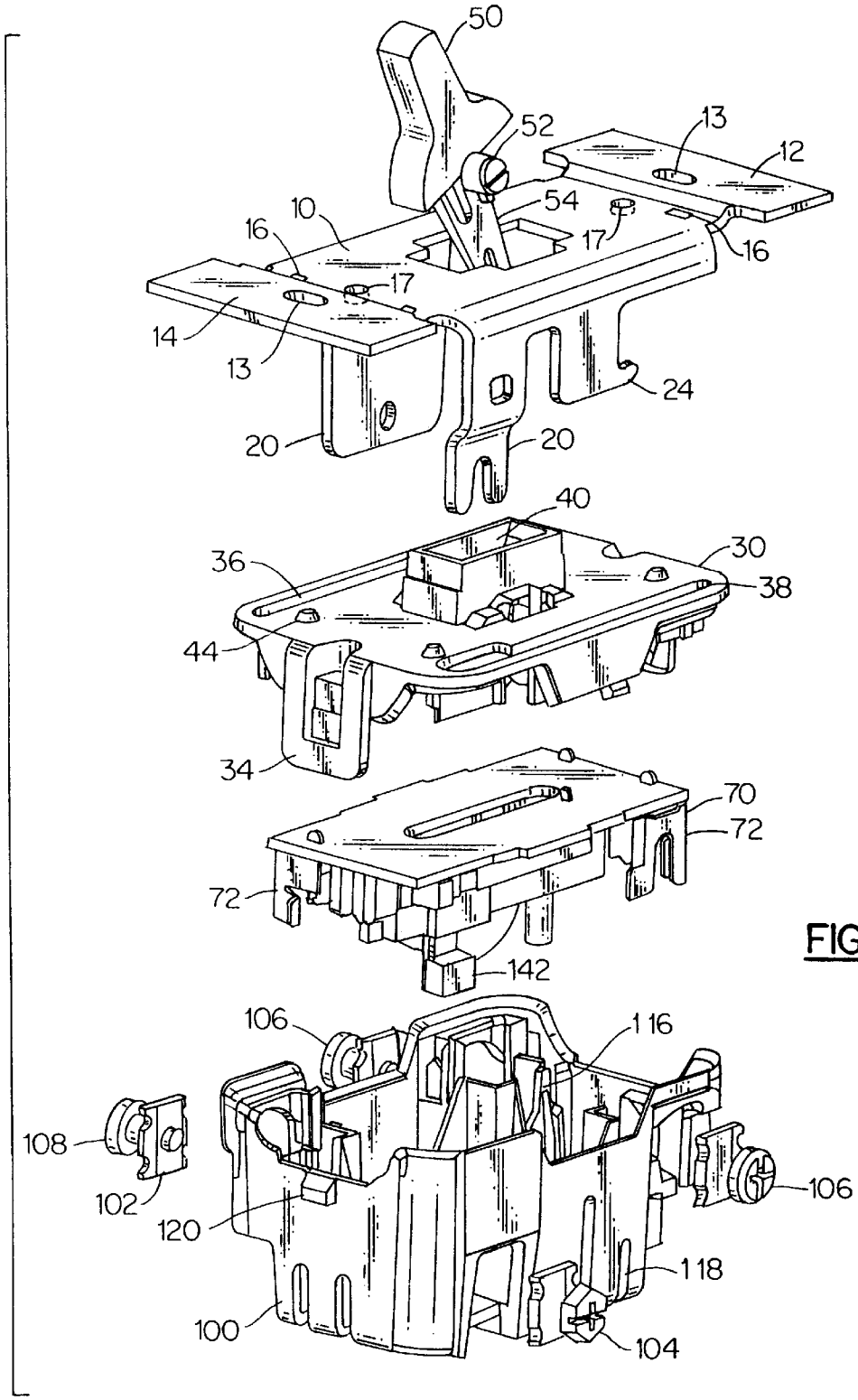
FIG. 3 shows an exploded view of the electrical control box of FIG. 2.

FIG. 1 shows an exploded view of an electrical control box according to an embodiment of this invention. FIGS. 2 and 3 show another embodiment of an electrical control box. The embodiments illustrated in these figures accommodate a toggle switch, but these electrical control boxes may accommodate a slide switch.

Each embodiment includes a strap-heat sink 10, a cover 30, a printed circuit board 70, and a back body 100.

The back body 100 is formed as a generally rectangular box shape having an open face. The box forming the back body 100 preferably has generally rounded or beveled corners to minimize the potential for injury to a worker and for damage to wall surfaces upon installation or removal. The body is formed with an inner recessed wall 114 along the periphery of its open face so as to support an overlying printed circuit board 70. Further support for the printed circuit board 70 is provided by the screw terminals 116, in the form of contoured projections, located inside the corners of the back body 100. The screw terminals and recessed wall secure the PC board 70 in a manner that there is adequate space within the back body for containing discrete components such as components 74, 76, and 140 on the board 70 and for maintaining these components at a desired spacing from the other components of the assembly. Recesses 110 are formed in the back body 100 toward the base on two opposing sides near each of the four comers of the base. The recesses are bound on one side by a pressure plate retaining clip 112 which may be integrally formed with the remainder of the back body. Generally rectangular pressure plates 102 having notched sides and a central threaded aperture are retained in the apertures 110. A primary function of the pressure plates 102 is to capture stripped field wire inserted through openings 200 on the back surface of the back body 100, these openings being visible in FIG. 9. The pressure plates 102 alternatively permit the field wire to be wrapped around the screws 104, 106, 108 on the exterior of the electrical control box. Screws 104, 106, 108 for connecting to electrical wiring exterior of the box are screwed into the threaded apertures in the pressure plates 102. Typically, the ends of the ends of the screws 104, 106, 108 are deformed to prohibit removal of the screws from the threaded apertures. The back body further includes male snap projections 120 at the center of the open face on opposing sides so as to retain securely the cover 30.

The back body 100 may be constructed of a plastic material such as a polycarbonate. Polycarbonate is an inexpensive material providing the necessary stiffness and strength, and does not change properties with elevated temperatures encountered in dimmer switch applications. Of course, other insulating materials which are sufficiently sturdy may be used.

Back bodies have been utilized before in dimmer switch electrical boxes, but typically, such back bodies have not incorporated screw terminals. Such prior back bodies are really just ordinary boxes. One recent back body was used in a toggle dimmer with screw terminals but this arrangement could not be converted to accommodate a slide switch because the PC board was oriented vertically with respect to the base of the back body and the face plate, rendering this back body impractical for slide dimmers.

Accordingly, the back body employed in the present invention is more complex than those used in the prior art. The back body of the present invention provides housing for the extension 20 of the heat sink 10, to which the triac 74 is connected, and for the flap 22 of the heat sink 10, to which the ground screw 104 is connected. The back body also incorporates multiple pressure plates 102—one ground pressure plate 102 for ground screw 104, and two or three power line pressure plates 102 for screws 106, 108. These pressure plates fully restrain movement (i.e., translation and torsion) of the terminals and provide protection from excessive torque at a higher rate than those found in known prior art devices. Also, the pressure plates can easily be replaced if they become damaged. Further, prior devices have tended to have lead lines coming directly from out of the back body, whereas screw terminals, as employed in the preferred embodiments of this invention, allow for direct attachment of the outside wiring to the electrical control box.

The ground screw 104 is part of the ground terminal that facilitates grounding of the heat sink/strap 10 of the unit. A hexagonal, (green) ground screw 104 and pressure plate 102 fit on the extended bent tab 22 from the heat sink. UL and CSA codes limit the temperature of any surface that may come into contact with insulation of field wiring to 75° C. On 1000 W units, the temperature of the ground screw terminal can reach above 75° C. Because the ground screw may reach such elevated temperatures, the ground terminal is enclosed within aperture 110 of the back body so as to isolate it from field wiring and prevent contact with other wiring. Nevertheless, the ground screw 104 is accessible to a user for side wiring—around the screw or through openings 200 in the vicinity of the screw.

In the present invention, a common platform is used for both a toggle operated switch and a slide operated switch. The common platform includes a circuit board 70, which is preferably a printed circuit board, although other types of circuit boards may be used. The circuit board 70 has various components on one of its major surfaces. Components such as 76 are conventionally soldered into a board having conductive pads and through holes. As illustrated, component 74 is a triac, and component 76 is a trigger bulb for the triac, and component 140 is a slide potentiometer. Essentially, these components serve as a switching mechanism when actuated by the slide or toggle switch, and regulate the light output intensity as determined by the position of the potentiometer. Because of these internal resistance of the components, power is dissipated, thereby generating heat. Of special concern is the dissipation of heat by the triac 74. In the past, the triac was mounted far from the circuit board to which it was electrically connected which required that the triac have long lead lines that presented a bottleneck for heat transfer. Also, in the past, the long lead lines of the triac required an extra labor intensive manual soldering step for installation of the triac. With the present invention, automatic wave soldering may be used to install the triac, thus facilitating assembly of the board 70. The PC board 70 is also provided with screw terminals 72—screws 104, 106, 108 pass into the apertures or notches of the screw terminals 72 to securely retain the board 70 to the back body 100.

An optional barrier plate 130 may be placed over the PC board 70. The barrier plate 130 has an aperture 132 to allow passage of the lever or arm from the toggle or slide switch. The barrier plate is made of a flame retardant, electrically insulating material such as fish paper. Typically, the barrier plate 130 is included only on 1000 W dimmers.

A cover 30 is provided to protect the circuit board 70, to secure the circuit board 70 within the back body 100, and to insulate the circuit board 70 and wiring internal to the back body 100. The cover 30 is secured to the back body 100 by mating snaps 34 on opposing sides of the cover which are releasably retained by corresponding mating snap projections 120 of the back body 100. The cover has a raised central portion through which an aperture 40 is formed to allow passage of a toggle lever 54 or slide arm 62. Spacers 44 maintain the distance between the strap-heat sink 10 and the surface of the front cover 30 to promote air circulation and cooling of the heat sink 10 on both sides. Retaining clips 32 project up from the cover 30 to pass through apertures on the strap-heat sink 10 to retain the strap-heat sink 10 to the cover 30. Snap projection tabs 42 project from the undersurface of the cover 30 to retentively connect to corresponding recesses formed in the back body 100. Side apertures 36 and 38 allow passage of portions 20, 22 and 24 of the strap-heat sink 10 so as to directly conduct heat away from the PC board 70.

The strap-heat sink 10 fits atop the cover 30. This component serves as a ground strap in that it is in electrical connection with the ground terminal. However, due to the configuration of the electrical control box of this invention, this component also serves as a heat sink that conducts heat away from the PC board and dissipates heat generated at the ground. The strap-heat sink 10 preferably formed from a generally flat thin metal stamping of a thermally conductive metal such as aluminum. Snap apertures 18 permit connection of the strap-heat sink 10 to the cover 30 by allowing passage of releasable clips 32 to retain the strap-heat sink to the cover 30.

A first heat sink flap 20 passes through aperture 36 of the cover and is placed in contact with triac 74 and is retained by eyelet 26 through aperture 25 and aperture 77 on a mounting tab of the triac 74. The heat sink strap 10 also has an extension flap 22 which passes through aperture 38 and directly connects to the ground screw 104, which helps dissipate the relatively large amount of heat generated at the ground. The strap-heat sink 10 increases the power dissipating capability of a triac, transistor, integrated circuit, or other active device.

Figure 7:
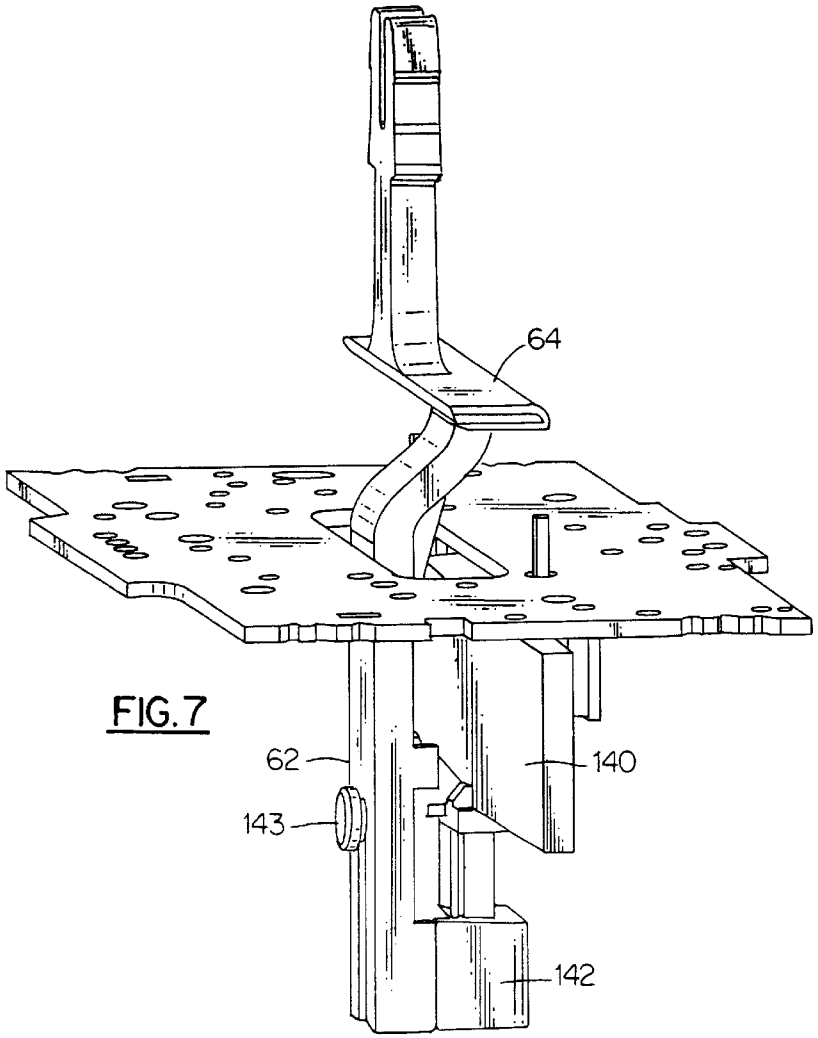
FIG. 7 shows a perspective view of a slide switch connected to a slide potentiometer.

Two ends 12 and 14 of the strap-heat sink 10 pass beyond the perimeters of the back body 100 and include holes 13 for receiving mounting screws. The strap-heat sink 10 furthermore is provided with openings 17 which are on standard centers and receive screws for attachment of a toggle switch decorative face plate (not shown). Because the strap-heat sink 10 is also adapted for use with a dimmer switch, in the illustrated embodiment there are three openings 16 for receiving snaps of an optional decorator cover 68 (as shown in FIG. 7).

The present invention may include an occupancy sensor, including those operating in the infrared and ultrasonic. Such sensors detection motion, and in response to the detected motion, automatically turn on lighting for a preselected length of time.

FIG. 2 shows an assembled toggle light switch. It can be seen that the female mating snap 34 of the cover 30 is engaged with the snap projection 120 of the back body 100. The terminal screws 104 and 106 are recessed within the outer surface of the back body 100. The raised lever housing 46 projects up from the cover 30, and the toggle switch knob 50 extends through recess 40.

The toggle switch includes a toggle switch actuator 50, a lever 54 that extends into the interior of the electrical control box, and a pivot pin 52. Pivot pin 52 serves as a pivot point for lever 54, such that lever 54 pivots about this pivot point as switch actuator 50 is moved arcuately. Lever 54 includes an aperture or notch 56 for connection to a slide potentiometer 140.

Figure 4:
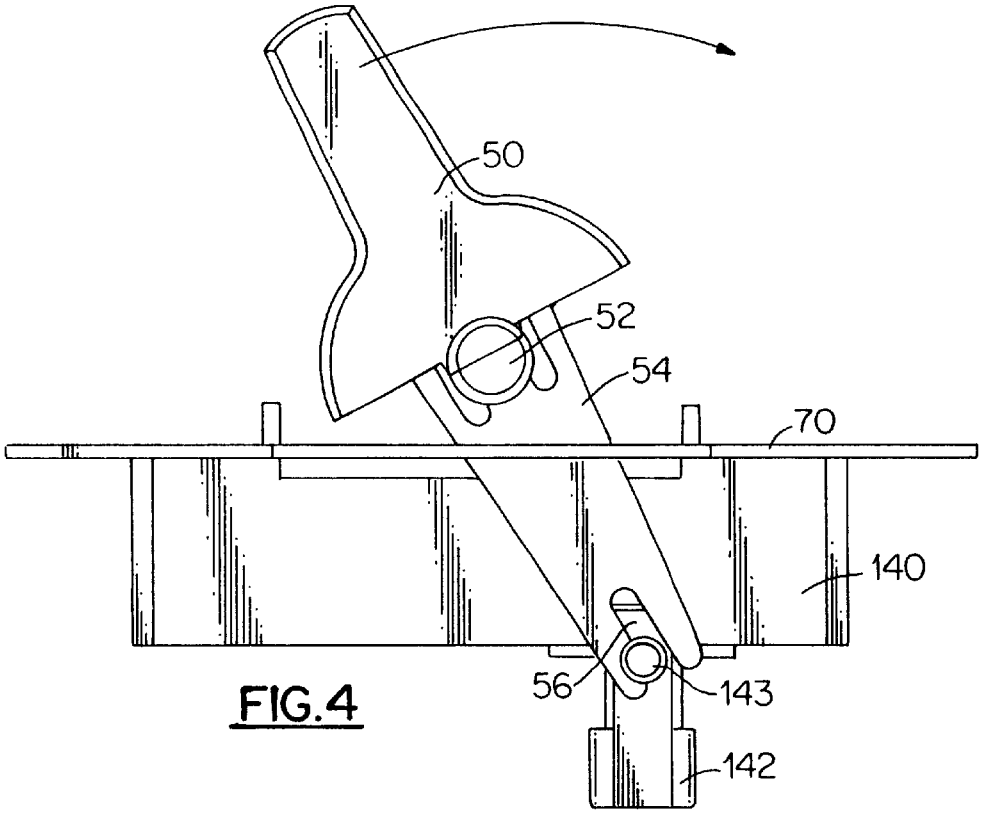
FIG. 4 shows a side view of a toggle switch connected to a slide potentiometer.
Figure 5:
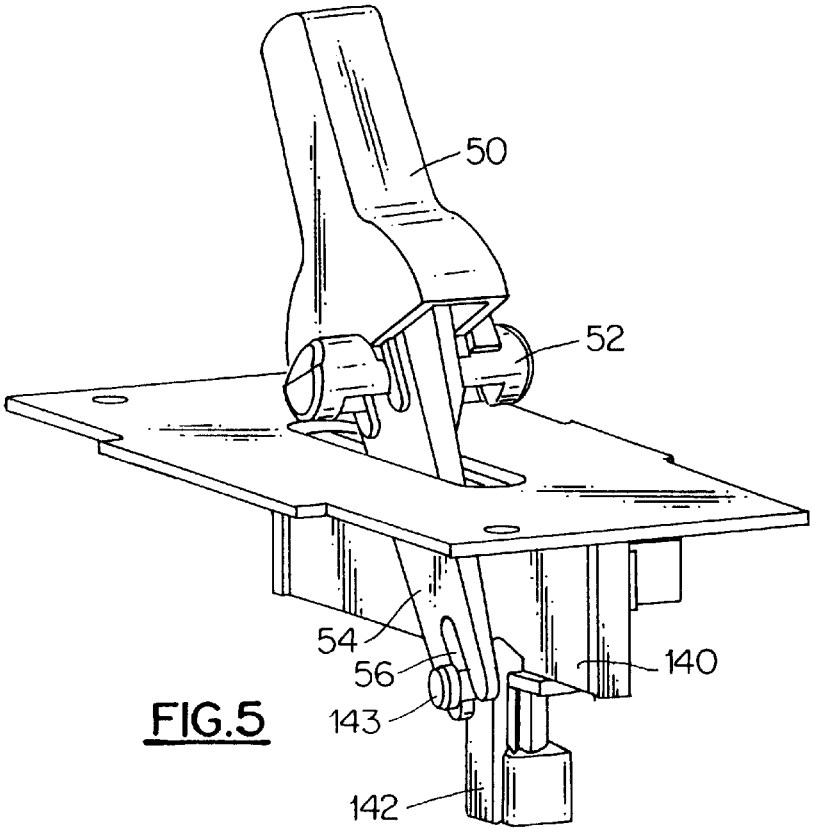
FIG. 5 shows a perspective view of a toggle switch connected to a slide potentiometer.

FIG. 4 shows a side elevational view of a toggle switch connected to a sliding potentiometer 140 on PC board 70, and FIG. 5 shows a perspective view of the toggle switch as it engages the slide potentiometer 140.

A unique feature of the present invention is the way the switch actuators interact with the slide potentiometer 140. The link actuator 142 is a key component. The link actuator 142 snaps on the end of the potentiometer 140 and provides a contact point for the toggle or slide actuator. The same link actuator 142 is common to slide or toggle switch modes. This contact point 143 of link 142 preferably has the form of a pin including a shaft and a knob at the end of the shaft. When used with the toggle switch, the shaft is received in notch or aperture 56, and this shaft is the pivoting point that allows transfer of the radial motion of toggling to the linear motion of the slide potentiometer on the PC board. In other words, as toggle switch 50 is moved in an arcuate path, the knob pin 143 travels within the aperture 56 at the end of the lever 54 of the toggle and travels across the length of slide potentiometer 140. The toggle pin 52 is retained by the cover so that it does not translate.

Figure 8:
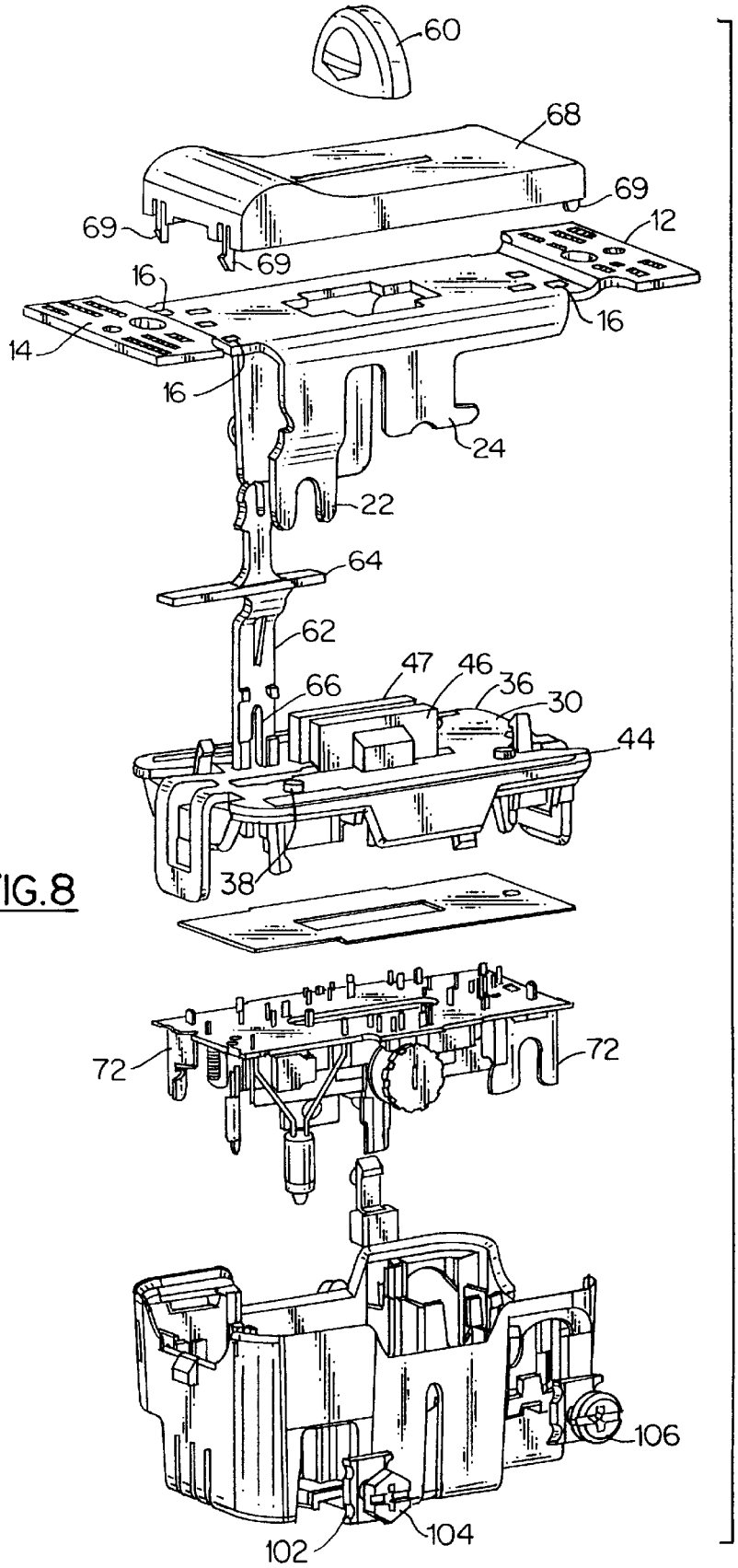
FIG. 8 shows an exploded view of an electrical control box according to another embodiment of this invention which has been adapted for a slide switch.

The embodiments shown in FIGS. 1 to 3 may be adapted for a slide dimmer switch, rather than a toggle switch, by substituting a slide dimmer switch assembly as illustrated in FIG. 7, and a slide dimmer cover 30 as illustrated in FIG. 8. The main distinction between the slide dimmer cover for toggle switch applications and the slide dimmer cover for slide switch applications is the structure of raised housing 46.

Figure 6:
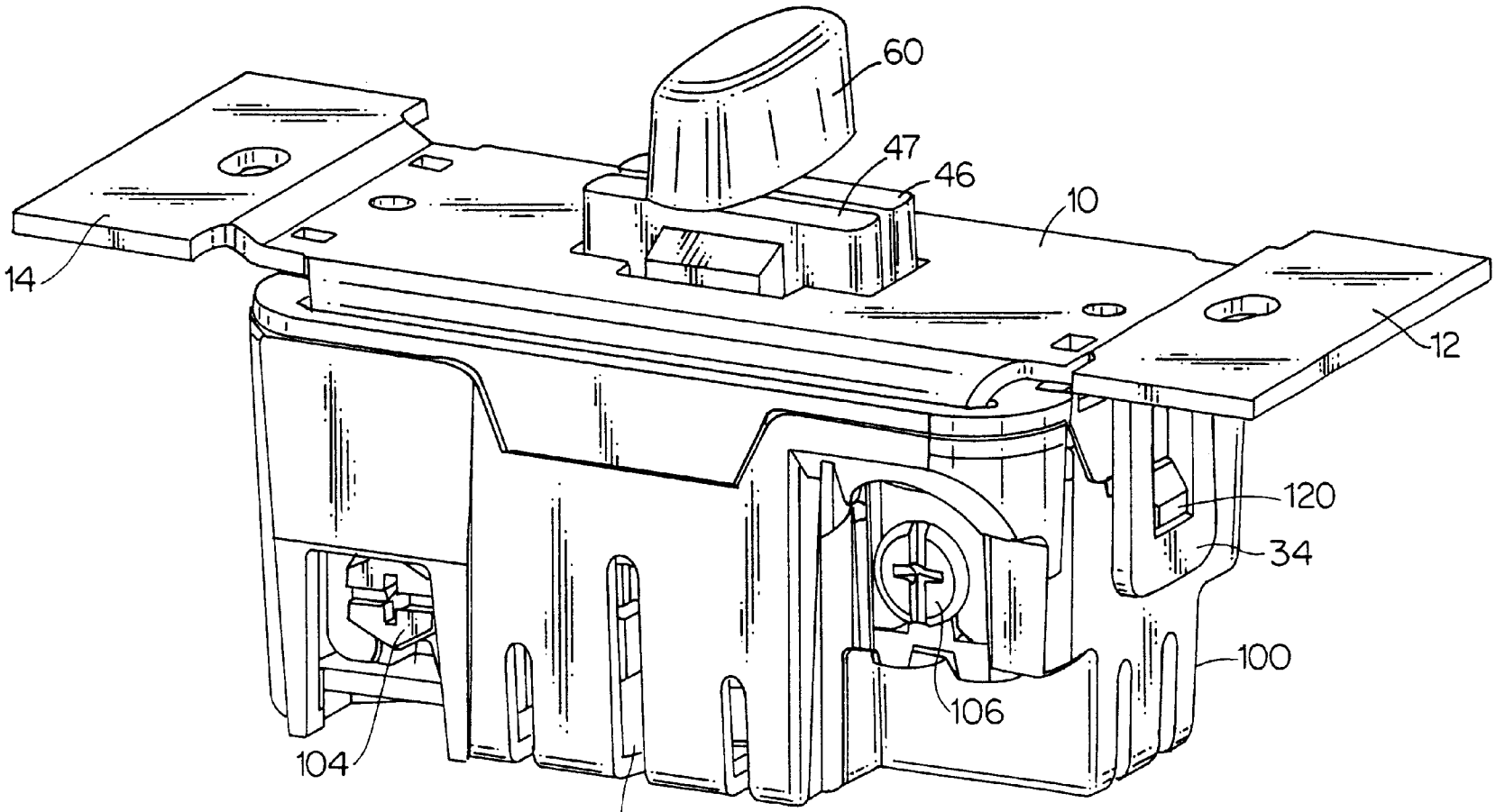
FIG. 6 shows the assembled electrical control box of FIG. 2 adapted for slide switching.

An assembly with a slide switch is shown in FIG. 6. In the case of the slide dimmer, the linear motion of knob 60 on the slide dimmer switch is transferred to a corresponding linear motion of the slide potentiometer using the same shaft on the link 142. FIG. 7 shows a perspective view of a slide dimmer switch. An upper portion of slide lever 62, to which knob 60 is attached on an assembled unit, travels within a slot 47 in the raised housing 46 on the cover 30. Slide bar 64 travels along the base of the raised housing. The slide lever 62 includes an aperture or notch 66 in its lower portion which fits around the knob pin 143 projecting from link 142 of the slide potentiometer 140. Thus, linear movement of the slide lever 62 translates to linear movement of the slide potentiometer 140 through link 142.

FIG. 8 shows an exploded view of another embodiment, this embodiment employing a slide switch to operate the dimmer. In the illustrated embodiment, there are three openings 16 in the strap-heat sink 10 for receiving snaps 69 of an optional decorator cover 68. The embodiment of FIG. 8 may be adapted for a toggle dimmer switch, rather than a slide switch, by substituting a toggle switch assembly as illustrated in FIGS. 4 and 5, and a toggle switch cover as illustrated in FIGS. 1 or 3.

Figure 9:
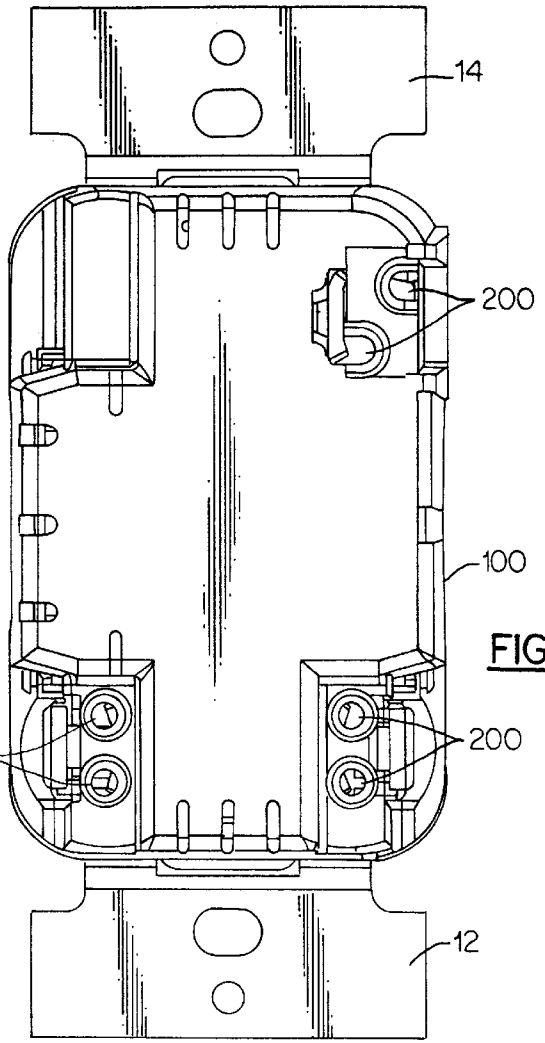
FIG. 9 shows a bottom view of the assembled electrical control box showing the outside base of the back body.

FIG. 9 shows a bottom view of the assembled unit. Entry points 200 for outside wiring are located by the screws 104 and 106. The pressure plates 102 provide more friction for contacting the wire which has been inserted. Conventionally, lead wires come out of the back body. In the present invention, the outside wires are attached to the back body by looping around the screws or by insertion into the entry points 200. This offers greater convenience for installation.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. An electrical lighting dimmer device, comprising:

a slide potentiometer;

a link actuator operably connected to the slide potentiometer and including a pin;

a lever arm comprising a pivot point, a longitudinal aperture in a lower portion of the lever arm below the pivot point in which the link actuator pin is received, and a toggle switch connected to an upper portion of the lever arm above the pivot point;

wherein arcuate movement of the toggle switch translated to linear movement of the link actuator;

wherein the slide potentiometer is mounted on a circuit board;

a back body and a front cover engageable with the back body;

the back body and the front cover enclosing a space in which the circuit board and slide potentiometer are contained;

wherein the front cover includes an aperture through which the lever arm extends;

wherein the circuit board has a major planar surface and the back body has a back surface, the planar surface of the circuit board being essentially parallel to the back surface of the back body, and the circuit board planar surface includes an aperture through which the lever arm extends.

2. An electrical lighting dimmer device, comprising:

a slide potentiometer;

a link actuator operably connected to the slide potentiometer and including a pin;

a lever arm comprising a pivot point, a longitudinal aperture in a lower portion of the lever arm below the pivot point in which the link actuator pin is received, and a toggle switch connected to an upper portion of the lever arm above the pivot point;

wherein arcuate movement of the toggle switch is translated to linear movement of the link actuator;

wherein the slide potentiometer is mounted on a circuit board;

a back body and a front cover engageable with the back body;

the back body and the front cover enclosing a space in which the circuit board and slide potentiometer are contained;

wherein the front cover includes an aperture through which the lever arm extends;

a metal strap having a planar surface disposed on a side of the cover opposed to the circuit board;

wherein the metal strap includes a ground flap that extends from the strap planar surface through an aperture in the cover and is in electrical and thermal connection with a ground terminal mounted on the back body.

3. The device of claim 2, wherein the metal strap further includes a second flap that extends from the strap planar surface through an aperture in the cover and is in thermal connection with a triac mounted on the circuit board.

4. An electrical lighting dimmer device, comprising:

a back body;

a circuit board supported by the back body;

a potentiometer connected to the circuit board;

a link actuator operably connected to the potentiometer; and a metal strap comprising a planar surface and a ground flap that extends from the strap planar surface and is in electrical connection with a ground terminal mounted on the back body, wherein the link actuator is connectable to both a lever arm of a toggle switch and a bar of a slide switch.

5. The device of claim 4, wherein the circuit board has a major planar surface and the back body has a back surface, the planar surface of the circuit board being essentially parallel to the back surface of the back body.

6. The device of claim 4, further comprising a front cover engaged with the back body and disposed between the circuit board and the metal strap.

7. The device of claim 6, wherein the front cover includes a first aperture through which said toggle switch lever arm or said slide switch bar extends when connected to the link actuator.

8. The device of claim 7, wherein the front cover includes a second aperture through which the ground flap extends.

9. The device of claim 4, wherein the potentiometer is a slide potentiometer.

10. A lighting control device, comprising:

a back body including a back surface, side walls extending from the back surface, and an open front face;

a circuit board supported on interior surfaces of the back body side walls, the circuit board having a major planar surface that is essentially parallel to the back body back surface and a potentiometer mounted thereon, the circuit board and potentiometer providing a signal to control intensity of light; and a link actuator connecting the potentiometer to a dimmer switch;

wherein the back body includes recesses in exterior surfaces of the side walls, and pressure plates retained in the recesses.

11. A lighting control device, comprising:

a back body including a back surface, side walls extending from the back surface, and an open front face;

a circuit board supported on interior surfaces of the back body side walls, the circuit board having a major planar surface that is essentially parallel to the back body back surface and a potentiometer mounted thereon, the circuit board and potentiometer providing a signal to control intensity of light; and a link actuator connecting the potentiometer to a dimmer switch;

a plurality of pressure plates adjacent exterior surfaces of the side walls;

wherein the pressure plates include ground or power terminals.

12. A lighting control device, comprising:

a back body including a back surface, side walls extending from the back surface, and an open front face;

a circuit board supported on interior surfaces of the back body side walls, the circuit board having a major planar surface that is essentially parallel to the back body back surface and a potentiometer mounted thereon, the circuit board and potentiometer providing a signal to control intensity of light;

a link actuator connecting the potentiometer to a dimmer switch;

a front cover engageable with the back body, such that the circuit board is enclosed in a space formed between the front cover and the back body; and a metal strap having a planar surface disposed on a side of the front cover opposed to the circuit board;

wherein the back body includes recesses in exterior surfaces of the side walls, and pressure plates retained in the recesses.

13. The device of claim 12, wherein the pressure plates include apertures for ground screws or power terminal screws.

14. The device of claim 13, wherein the metal strap includes a ground flap that extends from the strap planar surface through an aperture in the cover and is in electrical and thermal connection with a ground terminal mounted on the back body.

15. The device of claim 14, wherein the metal strap further includes a second flap that extends from the strap planar surface through an aperture in the cover and is in thermal connection with a triac mounted on the circuit board.

16. The device of claim 15, wherein the ground flap dissipates heat from the ground terminal, and the second flap dissipates heat from the triac.

17. The device of claim 13, wherein the back surface of the back body includes holes aligned with the ground and power terminals, whereby external wiring inserted through the holes is connected to the ground and power terminals.

18. A lighting control device, comprising:

a back body including a back surface, side walls extending from the back surface, and an open front face;

a circuit board supported on interior surfaces of the back body side walls, the circuit board having a major planar surface that is essentially parallel to the back body back surface and a potentiometer mounted thereon, the circuit board and potentiometer providing a signal to control intensity of light;

a link actuator connecting the potentiometer to a dimmer switch; and a toggle lever arm which connects the link actuator with a toggle switch knob, the toggle lever arm extending through an aperture in the circuit board.

* * * * *